US005440844A

United States Patent [19]

Chihara et al.

[11] Patent Number: 5,440,844

[45] Date of Patent: Aug. 15, 1995

[54] CONNECTORS FOR BUILDING UNIT

[75] Inventors: Katsuyuki Chihara, Tokyo; Kazunari Ishii, Yamato; Akira Kishi, Tokyo, all of Japan

[73] Assignee: Misawa Homes Co., Ltd., Tokyo, Japan

[21] Appl. No.: 201,152

[22] Filed: Feb. 24, 1994

Related U.S. Application Data

[63] Continuation of Ser. No. 817,484, Jan. 7, 1992, abandoned.

[30] Foreign Application Priority Data

| | | | |
|---|---|---|---|
| Jan. 9, 1991 | [JP] | Japan | 3-023653 |
| Apr. 9, 1991 | [JP] | Japan | 3-104707 |
| Nov. 18, 1991 | [JP] | Japan | 3-329941 |

[51] Int. Cl.[6] ..... E04B 1/18

[52] U.S. Cl. ..... 52/280; 52/656.9; 211/191; 403/172

[58] Field of Search ..... 52/280, 656.1, 656.9, 52/657, 658; 403/169, 170–176, 403; 312/265.1, 111; 211/182, 189, 191

[56] References Cited

U.S. PATENT DOCUMENTS

| | | | |
|---|---|---|---|
| 3,023,032 | 2/1962 | Johnston et al. . | |
| 3,305,255 | 2/1967 | Henderson | 52/280 X |
| 3,315,994 | 4/1967 | Rifken | 403/169 |
| 3,886,710 | 6/1975 | Krause et al. | 403/172 X |
| 4,037,376 | 7/1977 | Baal-Taxa | 52/280 |
| 4,125,973 | 11/1978 | Lendrihas . | |
| 4,230,052 | 10/1980 | Champagne | 211/189 |
| 4,283,900 | 8/1981 | Schubert | 52/656.9 |
| 4,869,380 | 9/1989 | Metcalfe et al. | 211/189 |
| 4,885,883 | 12/1989 | Wright | 52/280 |
| 4,974,386 | 12/1990 | Eriksson et al. . | |

FOREIGN PATENT DOCUMENTS

| | | |
|---|---|---|
| 898605 | 5/1984 | Belgium . |
| 2336482 | 2/1975 | Germany . |

*Primary Examiner*—Carl D. Friedman
*Assistant Examiner*—Kien T. Nguyen
*Attorney, Agent, or Firm*—Lowe, Price, LeBlanc & Becker

[57] ABSTRACT

A connector for connecting a column with two beams in a building unit constructed with a plurality of columns and beams connected to each other comprises a core portion having the same sectional shape as the column and a branch portion having a web and parallel flanges enclosing the web in a right angles state, so that two surfaces of said core portion relate to the web and flanges in a state contacting to each other at right angles.

10 Claims, 19 Drawing Sheets

CONNECTORS FOR BUILDING UNIT

This application is a continuation of application Ser. No. 07/817,484, filed Jan. 7, 1992, now abandoned.

FIELD OF THE INVENTION

This invention relates to a connector which is applied to construct building units with a plurality of columns and beams connected to each other and also a process of producing the connector.

DESCRIPTION OF THE RELATED ART

Construction processes are known wherein building units are prepared in a factory, then transported to a building site, and assembled into a building. One type of conventional building unit, as depicted in FIG. 22, has a box shape which is constructed with four columns disposed at each corner of the unit, four beams between top portions of adjacent columns and four beams between bottom portions of adjacent columns. The box like building unit is completed with inner and outer boards, ceiling boards and floor boards.

A connecting process for columns and beams in the building unit is exemplified in Japanese Publication No. 59-16402 in which the beams are welded into the columns directly or indirectly via joints made of C-channel. According to the direct connecting process shown in FIG. 19, a short beam 3 and a long beam 4 are directly welded into column 2 at two adjacent surfaces respectively at one end portion thereof. The beams 3, 4 are made of C-channel and consist of vertical web 4A and a pair of horizontal flanges 4B. The column 2 includes an end cap 2C and an inner cap 2B, of which both are welded into the column 2 to strengthen it.

It is difficult to weld the caps 2B, 2C into the column 2, especially the inner cap 2B into a narrow inside portion of the column 2, resulting in poor work effectiveness.

To avoid such difficult welding jobs, another process is known, in which a C-channel like joint is welded into the column 2. This process is depicted in FIG. 20, in which a joint 100 is employed. The joint 100 has almost the same width as the column 2 at its base portion so as to be welded into one surface of the column 2 and more narrow width at its top portion so that the beam 4 can be welded thereinto. If the beam 4 is not too heavy, the caps are not always necessary since the joint 100 is welded into the column 2 over a large area. If beam 4 is too heavily, a safe strength of the unit can not be expected without the caps.

In FIG. 21 is shown another example for jointing a square column 2 with the short beam 3 and the long beam 4, of which both are made of C-channels, via joint members 111 and 112 which are vertically welded onto respective surfaces of the column 2. Each joint member 111, 112 has a U-shape with outer dimensions corresponding with inner dimensions of the beams 3 or 4 and has a positioning hole 113 or 114 which corresponds with positioning hole 3C or 4C of the beam 3 or 4 when the beam 3 or 4 is coupled to the joint member 111 or 112. Incidentally, each of the beam 3, 4 consists of a web 3A, 4A and a pair of flanges 3B, 4B which extend perpendicular from the top or bottom end of the web 3A or 4A.

Accordingly, when the beams 3, 4 are coupled to the column 2, the beams 3, 4 are moved until the positioning holes 3C, 4C of the beams 3,4 are aligned with the positioning holes 113, 114. Preferably, pins are inserted into respective holes to secure the beam 3, 4, so they are welded finally on the column 2.

With the above-explained process for constructing a building, the building units have different length and width, requiring beams 3, 4 of different length from each other.

It is generally known that when the beams 3, 4 are long, C-channel are used to provide sufficient strength in the finished unit. However, the outer dimensions of C-channel are always constant even if thickened, requiring dimensional increases to occur on the inside of the C-channel. Consequently, it is difficult to use the joint members 111, 112.

It was therefore inevitable to prepare different joint members for each beam which has different thickness. Besides, welding process can not be done uniformly by a so-called welding robot, so that working efficiency of welding is not desirable.

When thick beams 3, 4 are welded to the column 2, if the end surfaces of the beams 3, 4 are just cut out straight, enough welding can not be done, so that it was also inevitable to form the end surface of the beams 3, 4 to have a tilted surface.

When positioning the beams 3, 4 in relation to the column 2, the positioning work can be finished by aligning the positioning holes 3C, 4C of the beams 3, 4 with the positioning holes 113, 114 of the joint members 111, 112, which take much time.

The present invention has such objects to solve above problems and to provide a connector for a building unit as:

(1) non-welding process in a column;

(2) tight joint between columns and beams under a heavy weight; and (3) free thickness, positioning and joint of beam.

Another object of the present invention is to provide a process for producing the connector having high strength within a cheaper price.

SUMMARY OF THE INVENTION

According to the present invention, a connector for connecting a column with two beams in a building unit constructed with a plurality of columns and beams connected to each other comprises a core portion having the same sectional shape as the column and a branch portion having a web and parallel flanges enclosing the web in a right angles state, so that two surfaces of the core portion relate to the web and flanges in a state contacting to each other at right angles.

In the connector of the first embodiment, the branch portion includes a connector main body and an auxiliary web, the connector main body having a U-shaped beam joint portion at one end portion, whereby the beam connects to the beam joint portion and the column connects to a surface of the flange, the auxiliary web being attached to another U-shaped portion at the other end portion of the connector main body to form the other beam joint portion with forwarded end portions of the connector main body. The core portion is formed with the auxiliary web, a web of the connector main body and an L-shaped auxiliary member which is applied to an opened corner enclosed by the two webs.

In the connector of the second embodiment, the branch portion consists of two partial members, of which one has a pair of flanges being of a certain length from a forwarded end of its web and the other has a pair of flanges extending the entire length of its web.

In the connector of the third embodiment, the branch portion comprises a connector main body and a pair of flanges, the connector main body being formed into an L-shape with two webs intersecting each other, the flanges being respectively attached to upper and lower ends of the connector main body so that the column is connected on an outer surface of the flange, whereby a combination of forwarded end portions of the connector main body and flanges forms a beam joint portion. The core portion is formed with the pair of flanges, two webs of the connector main body and an auxiliary member which is attached to an opened corner enclosed by the two webs of the connector main body.

In the connector of the third embodiment, as the fourth embodiment, the core portion is formed with the column which goes through a hole provided on the one flange and is welded to the other flange.

In the connector of the fifth embodiment, the branch portion comprises a pair of flanges and a pair of auxiliary webs, the flanges being attached to both open ends of the core portion so that the column connects to the one flange surface, the auxiliary web being attached between edges both of the one flange and the other, so that forwarded end portions of the pair of flanges and the web therebetween form a beam joint portion.

In the connector of the sixth embodiment, the branch portion is made of a U-shaped material to be into a L-shape, so that the column connects to an outer surface of the one flange and the beam connects to a U-shaped end. And the core portion is formed with an L-shaped web of the branch portion and a sectional L-shaped auxiliary member attached to an opened side of the L-shaped web.

The process for producing the connector in the first embodiment has the steps of folding plate material to make a web and a pair of flanges which are parallel to each other and are at right angles to the web, forming a beam joint portion at one U-shaped end of the folded plate material, adding an auxiliary web to the other U-shaped end of the folded plate material to form another beam joint portion with forwarded end portions of the auxiliary web a pair of flanges, and adding an auxiliary member to an opened corner enclosed by the auxiliary web and web of the folded plate material, so that a square portion is made by the two webs and the auxiliary member.

The process for producing the connector in the third embodiment has the steps of folding plate material to form two webs intersecting each other as a connector main body, adding a pair of flanges to both ends of the connector main body to form a pair of beam joint portions to which the beams are connected respectively, and adding an auxiliary member to an opened corner enclosed by the two webs of the folded plate material, so that a square portion is made by the two webs and the auxiliary member.

The process for producing the connector in the fifth embodiment has the steps of cutting a predetermined lengthwise core portion out of square pole like material, adding a pair of flanges to both ends of the core portion, the one flange being used to be connected with the column, adding a pair of auxiliary webs, the auxiliary web being attached between edges both of the one flange and the other, so that forwarded end portions of the pair of flanges and the web therebetween form a beam joint portion.

Incidentally, adding or attaching as used in this specification does not always mean by a welding process. Other processes are of course available if a tight connection can be secured.

DETAILED DESCRIPTION OF THE PREFERRED EMBODIMENT(S)

Figure 1:
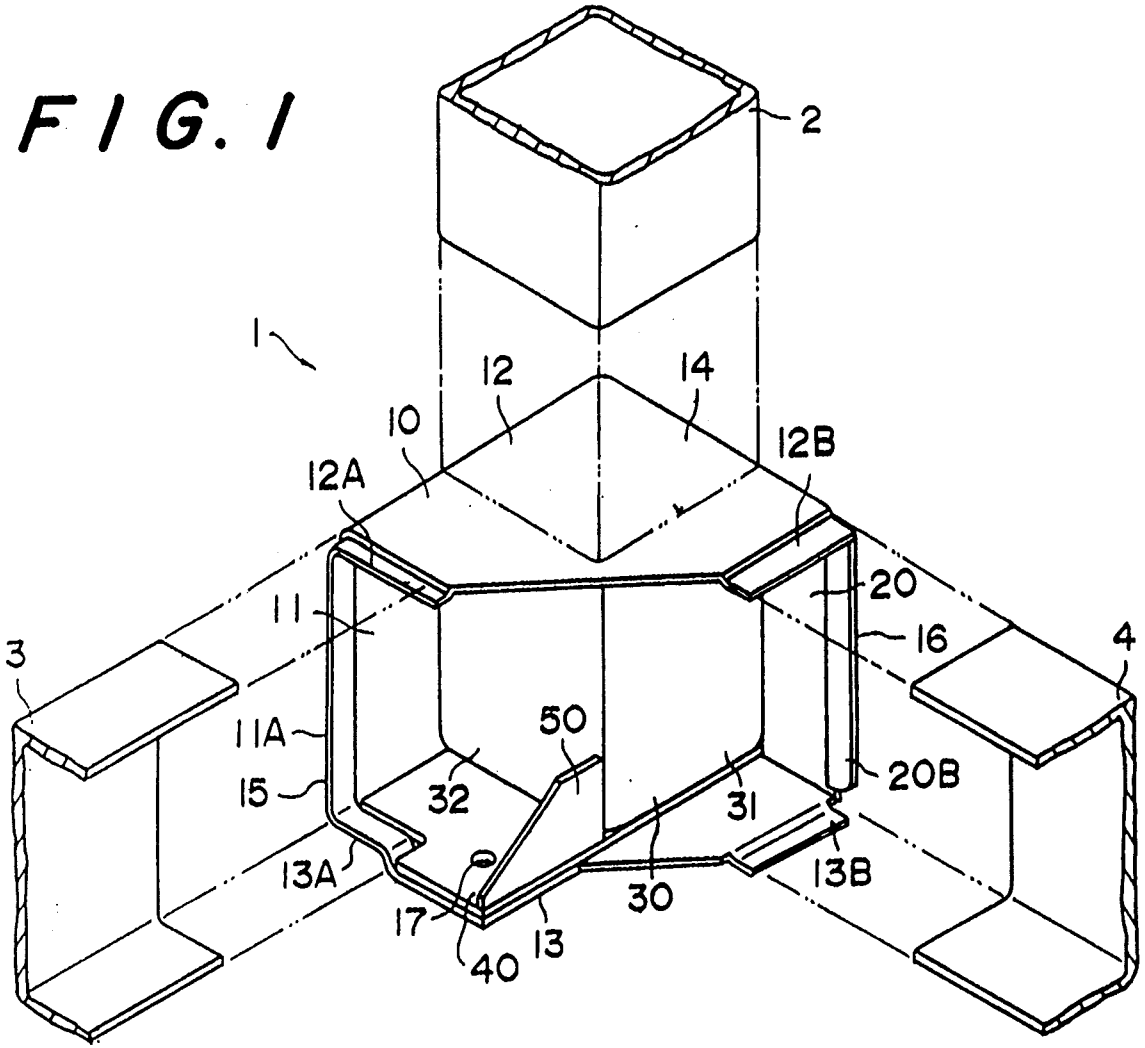
FIG. 1 is a perspective view showing positional relationship among a connector described in the first embodiment of the present invention, columns and beams.

The first through sixth embodiments of a connector in the present invention are described hereinafter.

In the followings, same or similar constructions to each other are denoted by same numerals and explanations thereof are abbreviated or simplified.

FIRST EMBODIMENT

The first embodiment of the present invention will be explained with reference to FIGS. 1 through 8.

In these drawings, denoted by numeral 1 is a connector in this embodiment, numeral 2 is a column shaped into a square pole, numerals 3, 4 are beams made of C-channel shape steel. The beam 3 is used as a gable beam and the beam 4 is used as a cross-beam in a building unit according to the present invention.

A connector 1 in the first embodiment comprises with a branch portion, which includes a connector main body 10 having a U-shaped surface at its one end and an auxiliary web 20 secured to the other end surface of the connector main body 10, a core portion, which is surrounded with the auxiliary web 20, the connector main body 10 and an auxiliary member 30 which is secured to an opened corner enclosed by two walls, and reinforcing members 40, 50.

The connector main body 10 comprises a web 11 and a pair of flanges 12, 13, which are parallel to each other and hold the web 11 therebetween, to thereby be shaped into the letter U. The upper flange 12 has a trapezoid shape of which an oblique line is cut by an angle of 45 degrees and of which upper surface is to be a connecting surface 14 where the column 2 can be connected thereunto. The lower flange 13 has a shape which is stepwise cut and of which a portion between steps is cut by an angle of 45 degrees.

Figure 4:
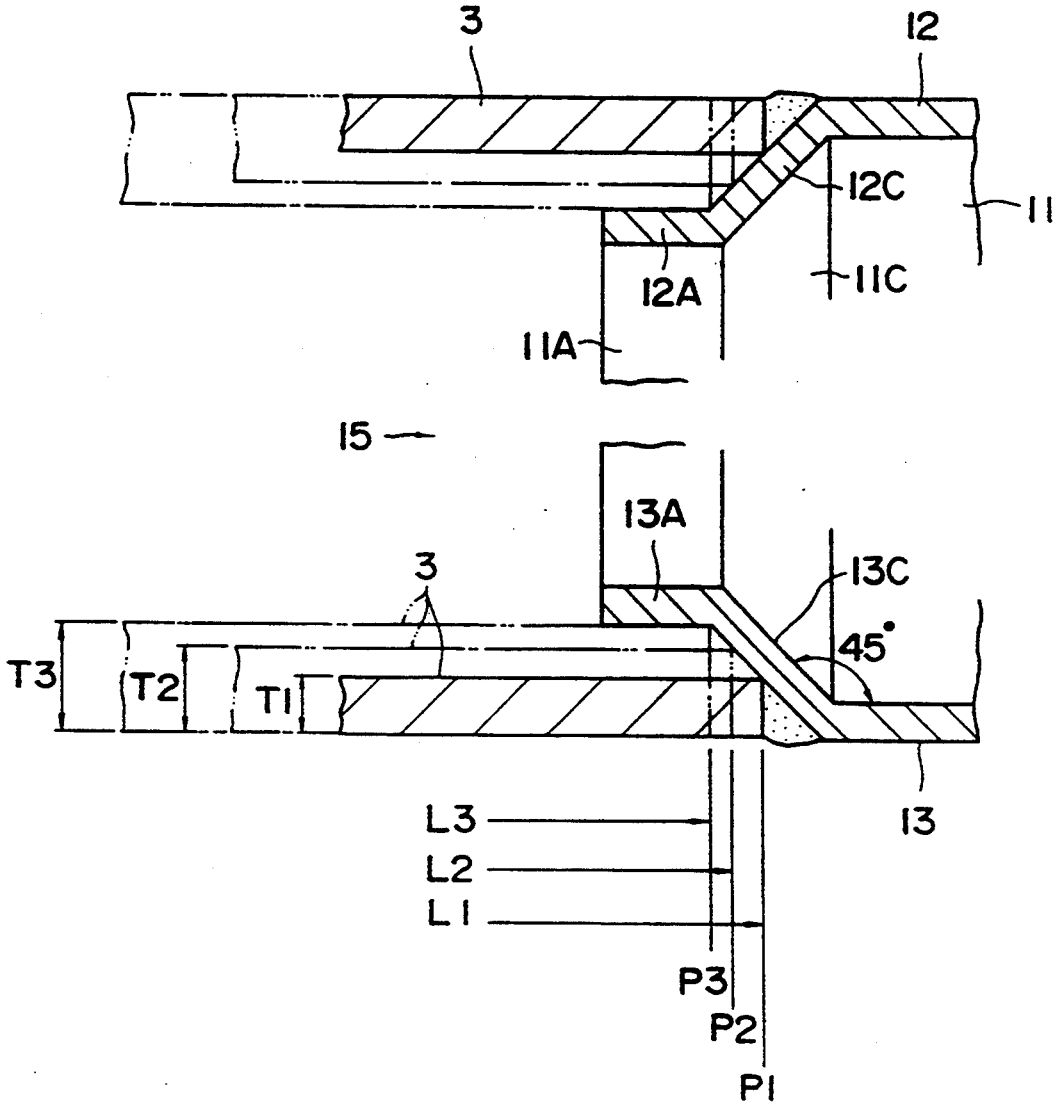
FIG. 4 is a sectional view showing a construction of one beam joint portion.

As shown in FIG. 4, one end portion at the left side of the U-shaped branch portion consisting of the web 11 and the upper and lower flanges 12, 13 is formed to have tapered portions 11C, 12C, 13C which are held inwardly by an angle of 45 degrees each other and guide edges 11A, 12A, 13A which are outwardly projected from forwarded end portions of the tapered portions 11C, 12C, 13C so as to be in a U shape. These tapered portions 11C, 12C, 13C and guide portions 11A, 12A, 13A form one beam joint portion 15 which allows the beam 3 to connect therewith.

Figure 5:
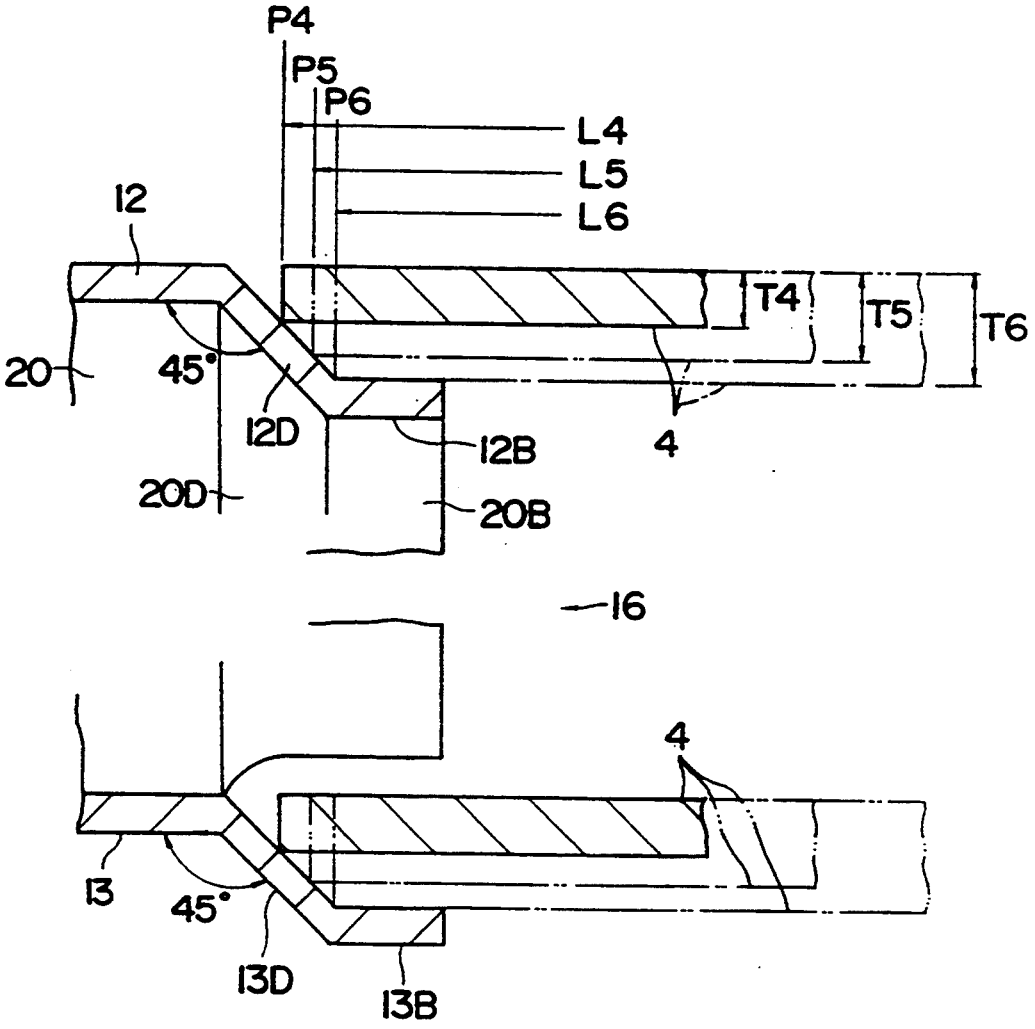
FIG. 5 is a sectional view showing a construction of the other beam joint portion.

In FIG. 5 is shown, at forwarded end portions of the upper and lower flanges 12, 13, tapered portions 12D, 13D held downwardly by an angle of 45 degrees and guide edges 12B, 13B projected outwardly from forwarded end portions of the tapered portions 12D, 13D.

The auxiliary web 20 is formed into a plate which can be secured to the other U-shaped end surface of the connector main body 10 so as to be at right angles to the web 11. The forwarded end portion of the auxiliary web 20 has a tapered portion 20D held inwardly by an angle of 45 degrees and a guide edge 20B projected outwardly from the forwarded end portion of the tapered portion 20D.

The tapered portion 20D and the guide edge 20B of the auxiliary web 20 and the tapered portions 12D, 13D and the guide edges 12B, 13B of the flanges 12, 13, form the other beam joint portion 16 to which the beam 4 can be connected.

In the above descriptions about the tapered portions, the tapered angle is not only at 45 degrees but also other degrees.

The auxiliary member 30 is attached or welded to the opened corner enclosed by the auxiliary web 20 and the web 11 of the connector main body 10 and has a L-shaped section so as to form the core portion with the auxiliary web 20 and the web 11. The L-shaped auxiliary member 30 consists of a web 31 parallel to the web 11 of the connector main body 10 and a web 32 parallel to the auxiliary web 20. The web 31 or 32 has the same width as the column 2 and the height determined by subtracting the thickness of the reinforcing member 40 from the inner distance between two flanges 12, 13.

The reinforcing member 40 is formed into a plate shape and is relating thicker than the connector main body 10 or the auxiliary web 20. The reinforcing member 40 is attached to the inner side of the lower flange 13 of the connector main body 10. The reinforcing member 50 is just formed into a triangle shape and is secured to a portion enclosed by the web 32 of the auxiliary member 30 and the reinforcing member 40 in a standing state. Denoted by numeral 17 near the reinforcing member 50 on the flange 13 of the connector main body 10 and on the reinforcing member 40 are holes for a bolt used to connect one lower building unit with the other upper building unit.

The followings are the explanations for producing the connector 1 according to the first embodiment.

In order to produce the connector main body 10, first of all, plate material made from steel is cut into a predetermined shape by a press machine and then folded to be in the letter U shape with the web 11 and the flanges 12, 13 which are hold the web 11 therebetween and parallel to each other. The upper surface of the upper flange 12 is to be a connecting surface 14 to which the column 2 can be connected. After drawing one end portion of the branch portion so as to deform into the letter U-shape with the tapered portions 11C, 12C, 13C and the guide edges 11A, 12A, 13A, the beam joint portion 15 can be made. The forwarded end portions of both the upper and lower flanges 12, 13 are preliminary processed to have the tapered portions 12D, 13D and the guide edges 12B, 13B.

Figure 2:
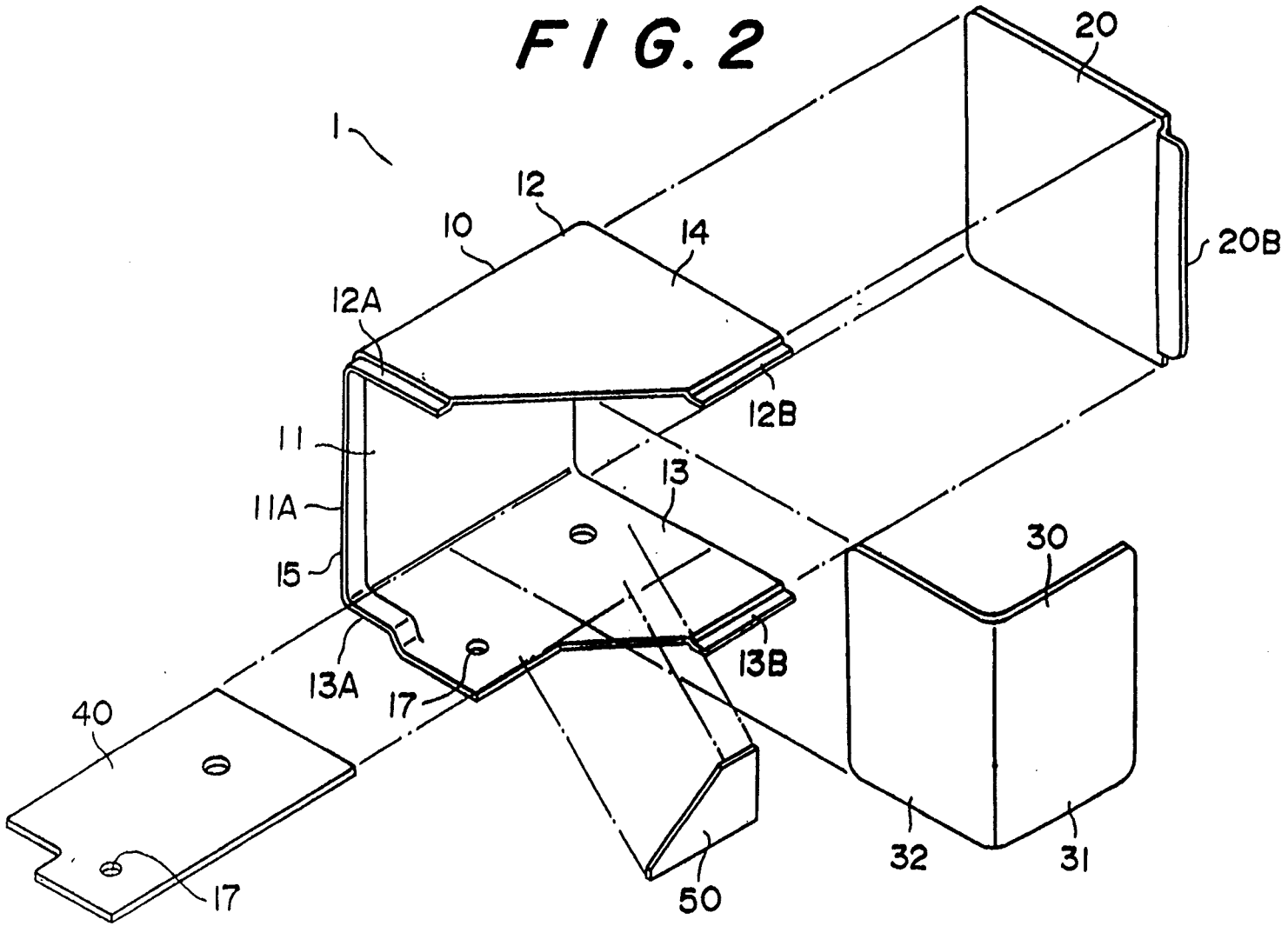
FIG. 2 is an exploded perspective view of the connector shown in FIG. 1.

The other members; the auxiliary web 20, the auxiliary member 30 and the reinforcing members 40, 50 should be preliminary cut into predetermined shapes respectively as shown in FIG. 2.

The steps for constructing the connector 1 of the first embodiment with the members 10, 20, 30, 40 and 50 can be begun by welding the auxiliary web 20 to the other U-shaped end surface of the connector main body 10 so as to be at right angles to the web 11. The welding should be done along the U-shaped configuration. The reinforcing member 40 is placed at the inner side of the flange 13 of the connector main body 10 and welded advantageously. The auxiliary member 30 is then attached to the opened corner closed by the auxiliary web 20 and the web 11 of the connector main body 10 and welded to the connector main body 10, the auxiliary web 20 and the reinforcing member 40 in due course. Lastly, the reinforcing member 50 is advantageously welded to thereby produce the fine connector 1.

Figure 3A:
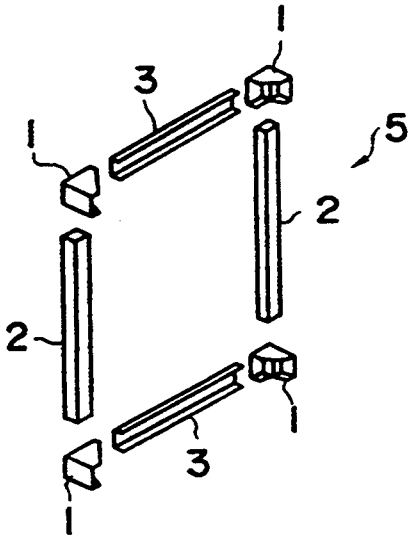
FIG. 3(A) through FIG. 3(C) are explanatory views for constructing a unit frame with the connectors.
Figure 3B:
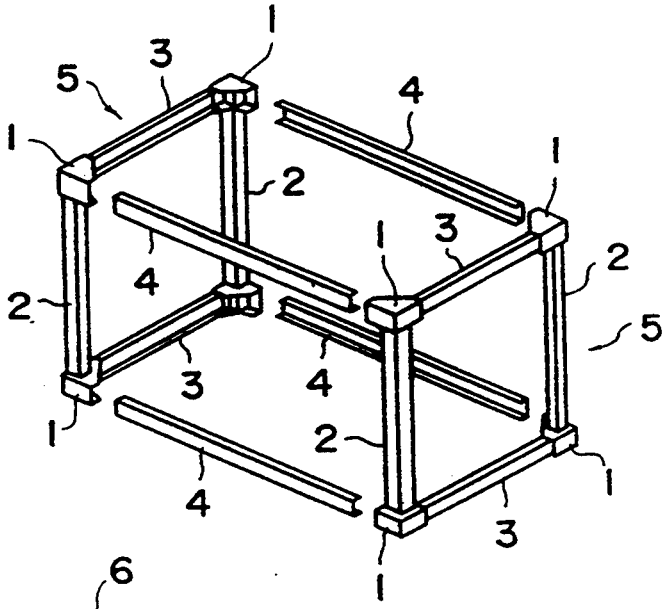
Figure 3C:
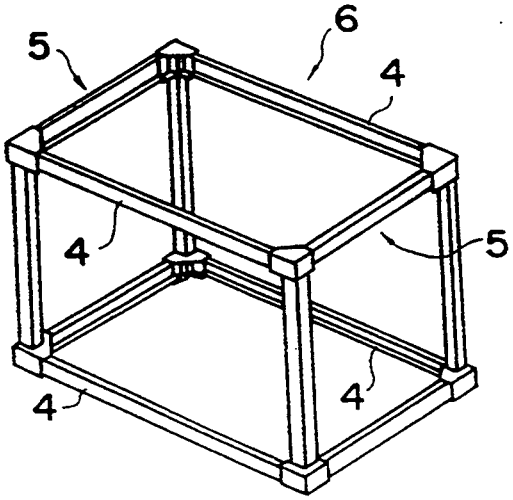

A process to construct the frame of the building unit by using the connectors 1 will hereunder be explained as shown in FIGS. 3(A) through 3(C).

As shown in FIG. 3(A), the connectors 1 are preferably welded to both ends of two columns 2. Between two connectors 1 is provided the beam 3 to thereby obtain a gable frame 5. If two columns 2 are moved to close to each other with keeping the same level of the outer surface of the web 11 of the connector main body 10 with that of the web 3A of the beam 3, the movement of two columns 2 is allowed until when a connecting end of the beam 3 abuts on the tapered portions 11C, 12C, 13C of the beam joint portion 15. The beam 3 is then decided on its longitudinal positioning and also on its lateral positioning due to the tapered portions 12C, 13C. Under the situation, both connecting ends of the beam 3 are welded to the tapered portions 11C, 12C, 13C to thereby obtain the gable frame 5.

If the thickness of the beam 3 is different, a position where the beam 3 will abut to the tapered portions 11C, 12C, 13C is also different. When the thickness of the beam 3 is "T1", FIG. 4, the contact point will be "P1" on the tapered portions 11C, 12C, 13C. When the thickness is "T3", the contact point will be "P3". Hence, beams which may have different thickness from each other can be used to form the desirable building unit frame by preliminary cutting by L1, L2, L3 in accordance with the respective thickness of T1, T2, T3.

As a next step to construct the frame of the building unit, as shown in FIG. 3(B), two gable frames 5 are placed opposite to each other to be connected by the beams 4.

When two gable frames 5 are moved to close to each other while keeping the same level of the upper flange 12 with that of the upper flange 4B of the beam 4 and also keeping the same level of the auxiliary web 20 with that of the web 4A of the beam 4, the movement of the two gable frames 5 is allowed until when the connecting end of the beam 4 abuts to the tapered portions 20D, 12D, 13D of the beam joint portion 16. Accordingly, the beam 4 can be decided on its longitudinal positioning and also on its lateral positioning due to the tapered portions 20D, 12D, 13D. Under the above-mentioned condition, after welding both connecting ends of the beams 4 to the tapered portions 20D, 12D, 13D, the desirable building unit 6 shaped into a box can be constructed as shown in FIG. 3(C).

If the thickness of the beam 4 is different, a position where the beam 4 will abut to the tapered portions 20D, 12D, 13D is also different. When the thickness of the beam 4 is "T4", FIG. 5, the contact point will be "P4" on the tapered portions 20D, 12D, 13D. When the thickness is "T5", the contact point will be "P5". Hence, any beams which have different thickness each other can be used to form the desirable building unit frame by preliminary cutting by L4, L5, L6 in accordance with the respective thickness of T4, T5, T6.

Accordingly, since the beam joint portions 15, 16 have the tapered portions 11C, 12C,13C and 20D, 12D, 13D respectively, the beams 3, 4 having different thickness can be connected to the column 2, so that various kinds of connectors do not need to be prepared. Moreover, production of the connector 1 is easy.

The longitudinal and lateral positioning of the beams 3,4 can be decided owing to mutual relationship between the tapered portions 11C, 12C, 13C or 20D, 12D, 13D and the thickness of the beam 3 or 4.

Since the beams 3, 4 can be directly welded to the tapered portions 11C, 12C, 13C and 20D, 12D, 13D, it is not necessary to deform end portions of the beams 3, 4 for easy joint between the beams and the corresponding connectors.

In the above-explanations, the beam joint portions 15, 16 are provided at the connector 1 to which the beams 3, 4 connected, but the beam joint portions 15, 16 may be provided at the connecting end of the beams 3, 4. Incidentally, the beam joint portion 15 or 16 may be provided only for either end portion of the connector 1.

Figure 6:
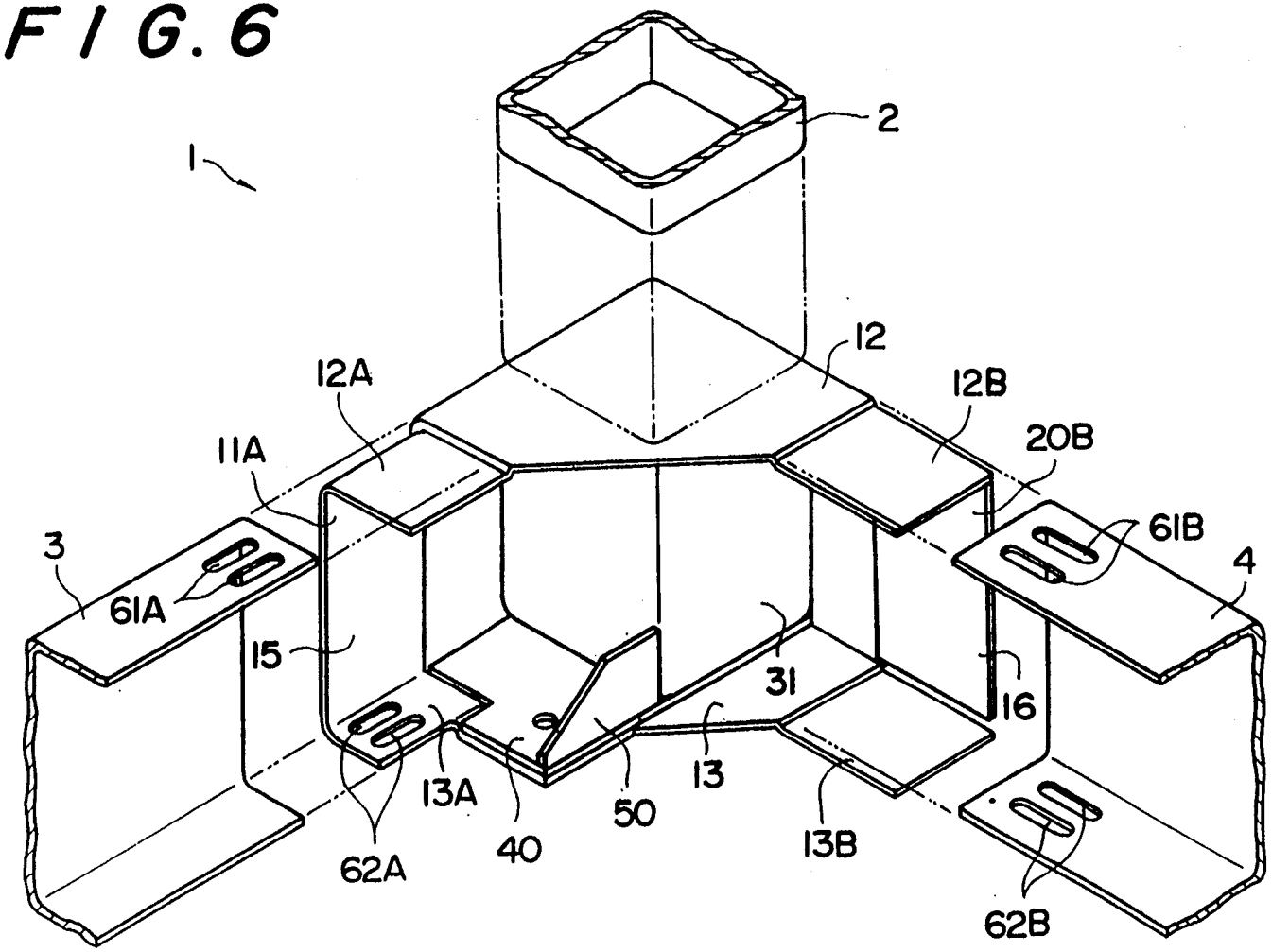
FIG. 6 is a perspective view showing a modification of the connector described in the first embodiment.

In FIG. 6 is shown a modification of the beam joint portions 15, 16.

The mentioned guide edges 11A, 12A, 13A, 20B, 12B, 13B of the beam joint portions 15, 16 are extended along the beams 3, 4. The upper members in a state that the beams are coupled onto the guide edges of the branch portion are provided with long holes 61A, 62A, 61B, 62B. In this situation, welding operation for the beams 3, 4 can be done downwardly through these holes 61A, 62A, 61B, 62B.

Figure 7:
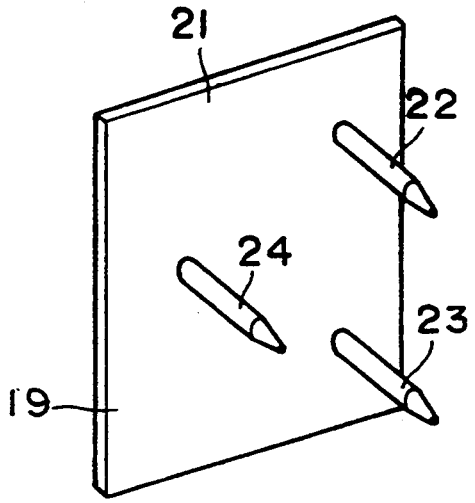
FIG. 7 is a perspective view of a positioning tool.
Figure 8:
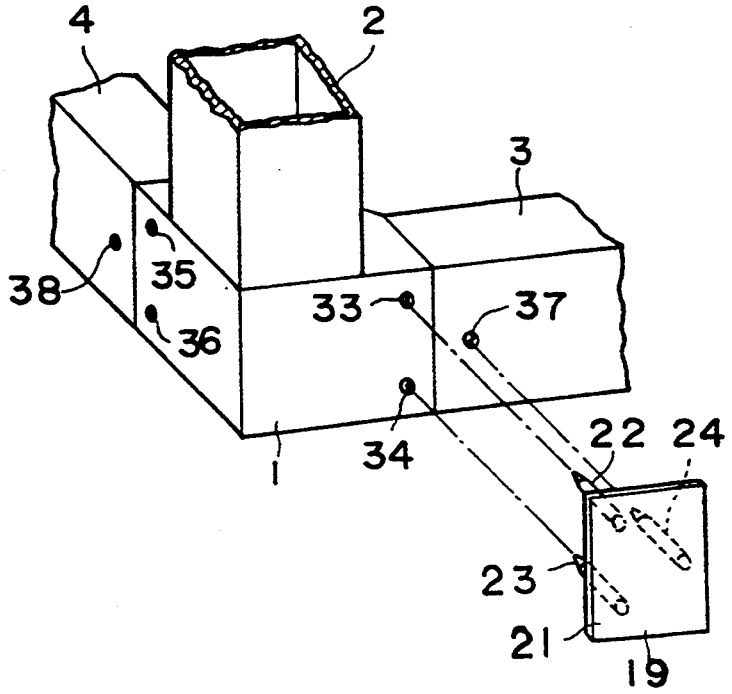
FIG. 8 is a perspective view showing a positioning process by using the positioning tool.

In FIGS. 7 and 8 is shown a positioning tool 19. The positioning tool 19 consists of a plate main body 21 and the first, second and third positioning pins 22, 23, 24. A positional relationship among these positioning pins 22, 23, 24 corresponds with holes 33, 34 or 35, 36 originally provided on the connector 1, of which each hole was used for positioning a material of the connector in a press machine, and with a hole 37 or 38 provided on the beam 3 or 4 preliminary opened.

When applying the positioning tool 19 to joint process between the beam 3 and the connector 1, the beam 3 is moved in relation to the connector 1 so that the positioning pins 22, 23, 24 correspond to the holes 33, 34, 35. If the positioning pins 22, 23, 24 are completely inserted into holes 33, 34, 37, the positional relationship between the beam 3 and the connector 1 is in a fine state. This also leads to the fine positioning of the beam 3 against the column 2. Since the holes 33, 34, 37 for the positioning pins 22, 23, 24 are provided on vertical surfaces both of the connector 1 and the beam 3, vertical positioning of the beam 3 in relation to the connector 1 can be kept in constant.

As a next step, temporary welding between the beam 3 and the connector 1 is done and the used positioning tool 19 is taken off to weld the beam 3 into the connector 1 perfectly. The mentioned positioning and welding process by using the positioning tool 19 can be naturally applied to another case to weld the beam 4 with the connector 1.

Incidentally, the above explained constructions around the beam joint portions 15, 16 can be applied to those in other embodiments which will be explained later.

The frame of the building unit 6 is finished up with inner and outer boards, ceiling boards, floor boards and interior goods such as integrated furniture. Accordingly, a planned building can be constructed with these building units. A joint process between the upper and lower building units can be performed with a preferable bolt and corresponding nuts, in which the bolt is inserted into the holes 17 on the flange 13 of the connector main body 10 and on the reinforcing member 40.

Hence, according to the first embodiment, the column 2 and the beams 3, 4 in the building unit can be tightly connected to each other via the connector 1. The auxiliary member 30, the auxiliary web 20 and the web 11 of the connector main body 10 form the core portion. The upper and lower openings of the surrounded core portion are closed with the flanges 12, 13 of the connector main body 10 as caps or diaphragms to thereby maintain a desirable joint between the column and the beams under a heavy weight. But, inside welding process in the column is not necessary in this embodiment.

Due to the reinforcing member 40, which is fixed on the inside of the lower flange 13 of the connector main body 10, and the reinforcing member 50, which is fixed in a standing state at a position enclosed by the reinforcing member 40 and the auxiliary member 30, the upper and lower connecting strength among the building units becomes better state.

The connector 1 is completed with the connector main body 10, the auxiliary web 20, the auxiliary member 30 and the reinforcing members 40, 50 by welding advantageously as a mono connector to thereby have enough strength. But, all the welding process can be finished from outside easily and efficiently.

Any modifications and developments of the explained first embodiment of the present invention should be included whenever the same objects will be achieved.

The applicable building unit for the connector is not only limited to the mentioned box-type frame but also a so-called U-type frame which do not have upper beams.

The welding process between the connector and the beams may be done in a spot weld method or a butt weld method.

To use the reinforcing members 40, 50 is not always necessary for the connector when the building unit is not expected to have so much strength. However, in this situation, the auxiliary member 30 should gain its height by the thickness of the reinforcing member 40.

As has been mentioned, according to the connector in the first embodiment, welding process inside of columns is no longer necessary and joint between columns and beams is enough under a heavy weight.

In the mentioned producing process, the connector can be produced in a cheaper price with keeping high strength.

SECOND EMBODIMENT

Figure 9:
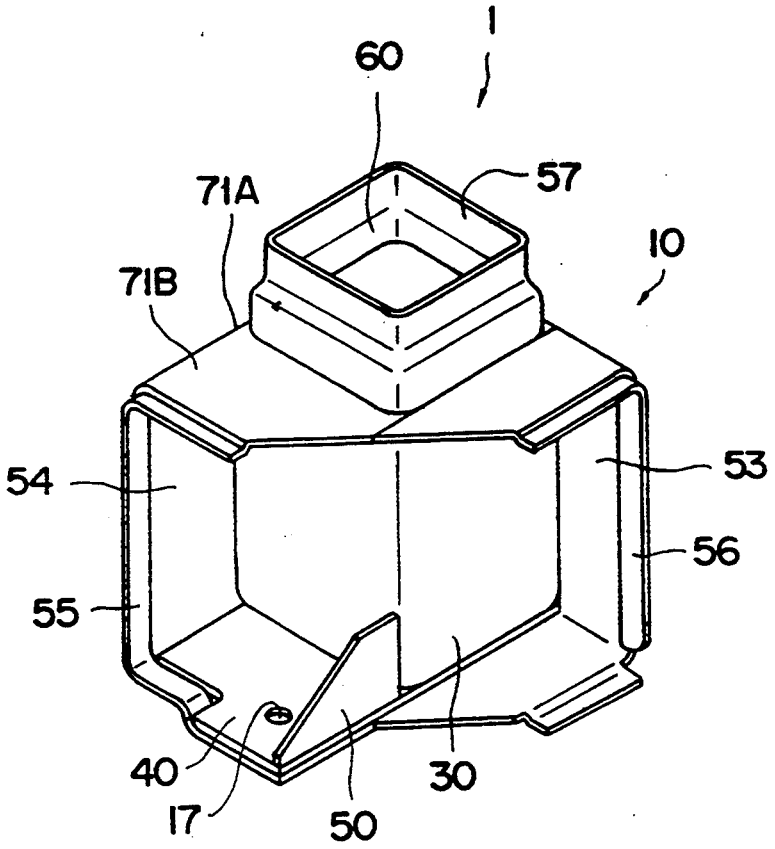
FIG. 9 is a perspective view showing a connector in the second embodiment of the present invention.
Figure 10:
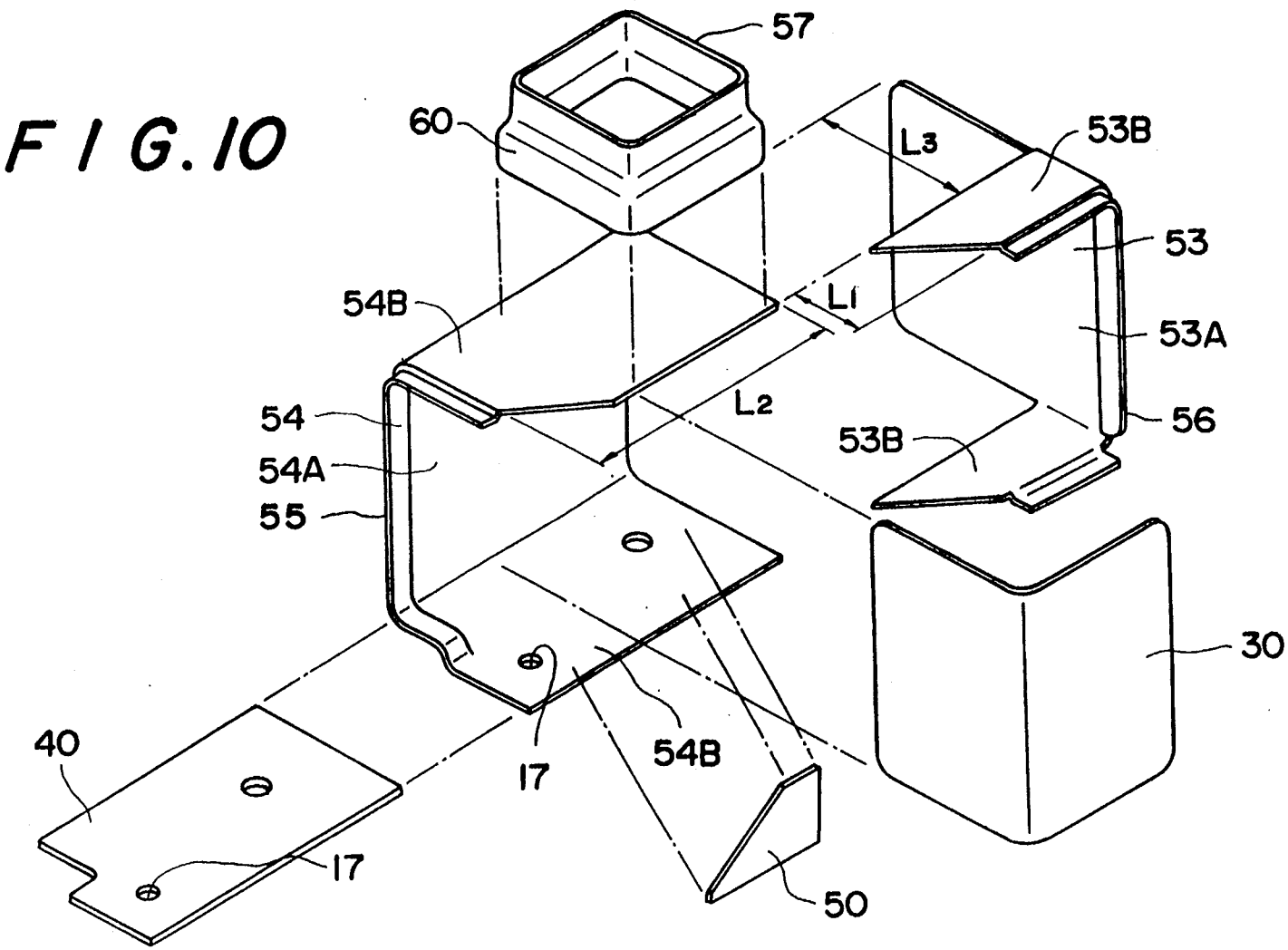
FIG. 10 is an exploded perspective view of the connector in FIG. 9.

The second embodiment of the present invention will hereunder be described with reference to FIGS. 9 and 10.

A connector 1 of this embodiment comprises a connector main body 10 as the branch portion, an auxiliary member 30 welded to an opened side of the main body 10 to form the core portion and a joint member 60 mounted on either of a pair of flanges 71B of the connector main body 10. A column 2 can be connected with the flange 71B via the joint member 60.

The connector main body 10 consists of a pair of partial members 53, 54, which have webs 53A, 54A and upper and lower flanges 53B, 54B, in a welded state to each other so as to form the branch portion. The flange 53B of the partial member 53 is at a length of $L_1$ from a forwarded end of the web 53A and the flange 54B of the partial member 54 is at a length of $L_2$ equal to a length of the web 54A. The width of the flange 54B of the partial member 54 is at a length of $L_3$ equal to non-flange portion of the partial member 53. Welding between a pair of the partial members 53, 54 is done by contacting backward portions of the upper and lower flanges 54B of the partial member 54 to the upper and lower end portions of the web 53A out of the flanges 53B of the partial member 53, whereby the upper and lower flanges 71B of the connector main body 10 is formed with the flanges 53B, 54B and whereby an external wall 71A is formed both with the webs 53A, 54A.

The forwarded end portions of the partial members 53, 54 are formed into beam joint portions 55, 56 as in the first embodiment, so that the connecting ends of the beams 3, 4 can couple onto the beam joint portions 55, 56. The joint member 60 is also provided with the same joint portion 57 as the beam joint portions in the first embodiment, to which the column 2 couples and is welded to the joint member 60. These joint portions 55, 56, 57 at the partial members 53, 54 and the joint member are advantageous to firmly and completely weld the partial members 53, 54 to the beams 3, 4 and also to weld the column 2 to the joint member 60 without doing backing weld.

The partial members 53, 54 may be made of C-channel material by cutting off or made of steel material by holding back. The joint member 60 can be made of a square pole by cutting off, otherwise it may be formed with two L-shaped parts by welding to each other. The L-shaped part can be produced with plate-like member by folding.

The connector 1 in the second embodiment also has the same effect as in the first embodiment.

THIRD EMBODIMENT

The third embodiment of the present invention will hereunder be explained with reference to FIG. 11.

The connector 1 consists of the branch portion, which comprises a L-shaped connector main body 10 and a pair of flanges 12, 13 joined to the upper and lower ends of the connector main body 10, the core portion, which is surrounded by a pair of flanges 12, 13, the connector main body 10 and a L-shaped auxiliary member 30 attached to an opened corner enclosed by the main body 10, and reinforcing members 40, 50.

The connector main body 10 consists of two webs 11, 20 in a state to be formed into the letter "L" shape. The webs 11, 20 have forwarded end portions where the guide edges 11A, 20B with tapered portions are provided as in the first embodiment.

The pair of flanges 12, 13 have the same configuration as in the first embodiment.

One end portions of the upper and lower flanges 12, 13, which are provided with the guide edge 11A of the web 11, are formed into the same guide edges 12A, 13A as in the first embodiment.

The guide edges 12A, 13A and the guide edge 11A of the connector main body 10 are to be of one beam joint portion to which the beam 3 is connected as in the first embodiment. The other end portions of the upper and lower flanges 12, 13, which are provided with the guide edge 20B of the web 20, are also formed into the same guide edges 12B, 13B as in the first embodiment. The guide edges 12B, 13B and the guide edge 20B of the connector main body 10 are to be of the other beam joint portion to which the beam 4 is connected as in the first embodiment.

Each constitution of an auxiliary member 30, reinforcing members 40, 50 and holes 17 is the same as in the first embodiment.

A process for producing the connector in the third embodiment will be explained hereunder.

In order to produce the connector main body 10, first of all, plate material made from steel is cut into a predetermined shape by a press machine and then folded to be in the letter L shape with the webs 11, 20. The forwarded end portions of these webs 11, 20 should be preliminary folded to form the guide edges 11A, 20B as in the first embodiment.

Figure 11:
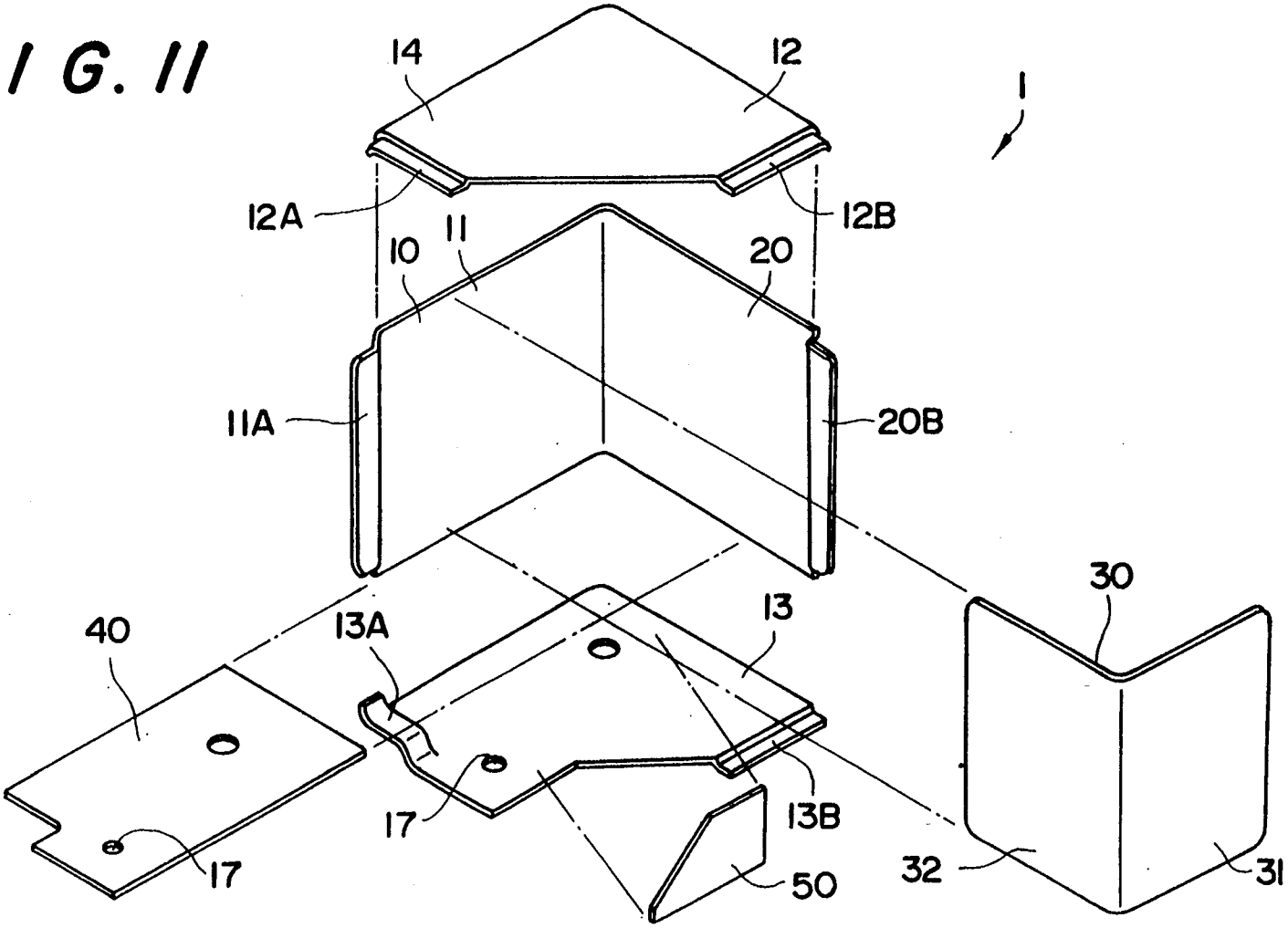
FIG. 11 is an exploded perspective view of a connector in the third embodiment of the present invention.

The each final shape of the flanges 12, 13, the auxiliary member 30 and the reinforcing members 40, 50 should be preliminary cut and preferably folded as shown in FIG. 11.

When assembling all members to the connector main body 10, the flanges 12, 13 are attached and welded to the upper and lower end surface of the connector main body 10 in a state being parallel to each other and being at right angles toward the webs 11, 20. The welding is done along the L-shape edge. Then, the reinforcing member 40 is put on the inner side of the flange 13 and welded preferably. The auxiliary member 30 is put to an opened corner enclosed by the upper and lower flanges 12, 13 and the two webs 11, 20 of the connector main body 10 and is welded to abutted portions on the connector main body 10, the upper flange 12 and the reinforcing member 40 in due course. Lastly, the reinforcing member 50 is attached and welded preferably to thereby produce the final connector 1.

The connector 1 in the third embodiment also has the same effect as in the first embodiment.

FOURTH EMBODIMENT

Figure 12:
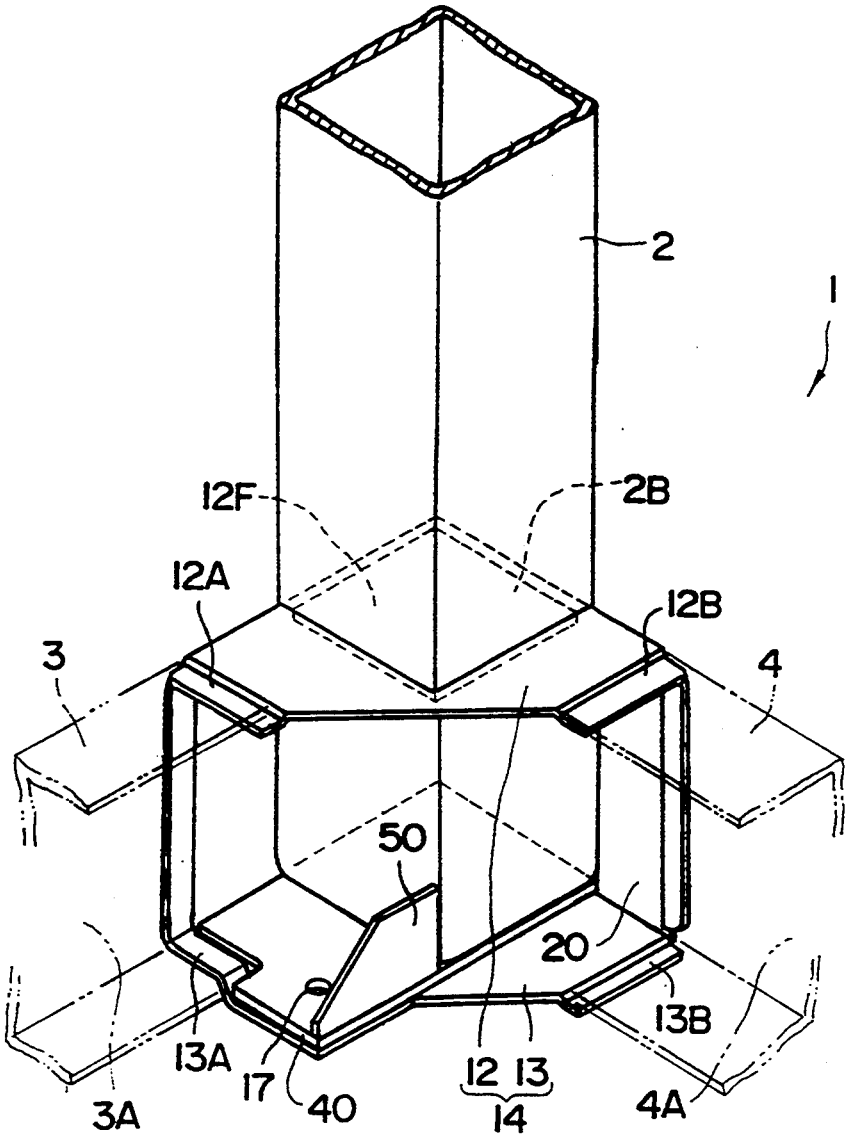
FIG. 12 is a perspective view showing a positional relationship among a connector in the fourth embodiment of the present invention, columns and beams.
Figure 13:
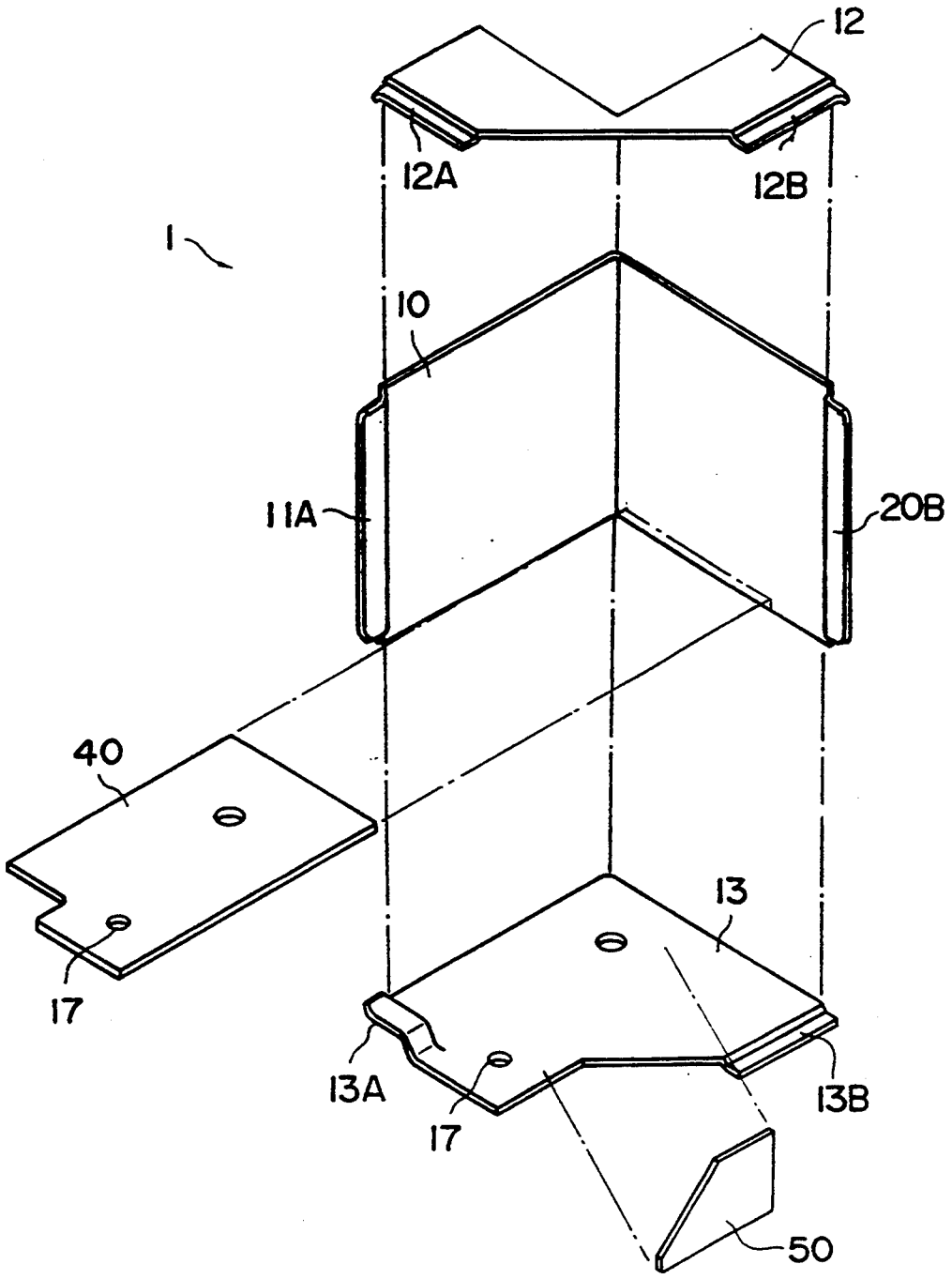
FIG. 13 is an exploded perspective view of the connector in FIG. 12.

The fourth embodiment of the present invention will hereunder be described with reference to FIGS. 12 through 14.

The whole construction of the connector 1 is almost same as in the third embodiment but has a difference that the flange 12 has a hole 12F through which the column 2 can be inserted.

Figure 14:
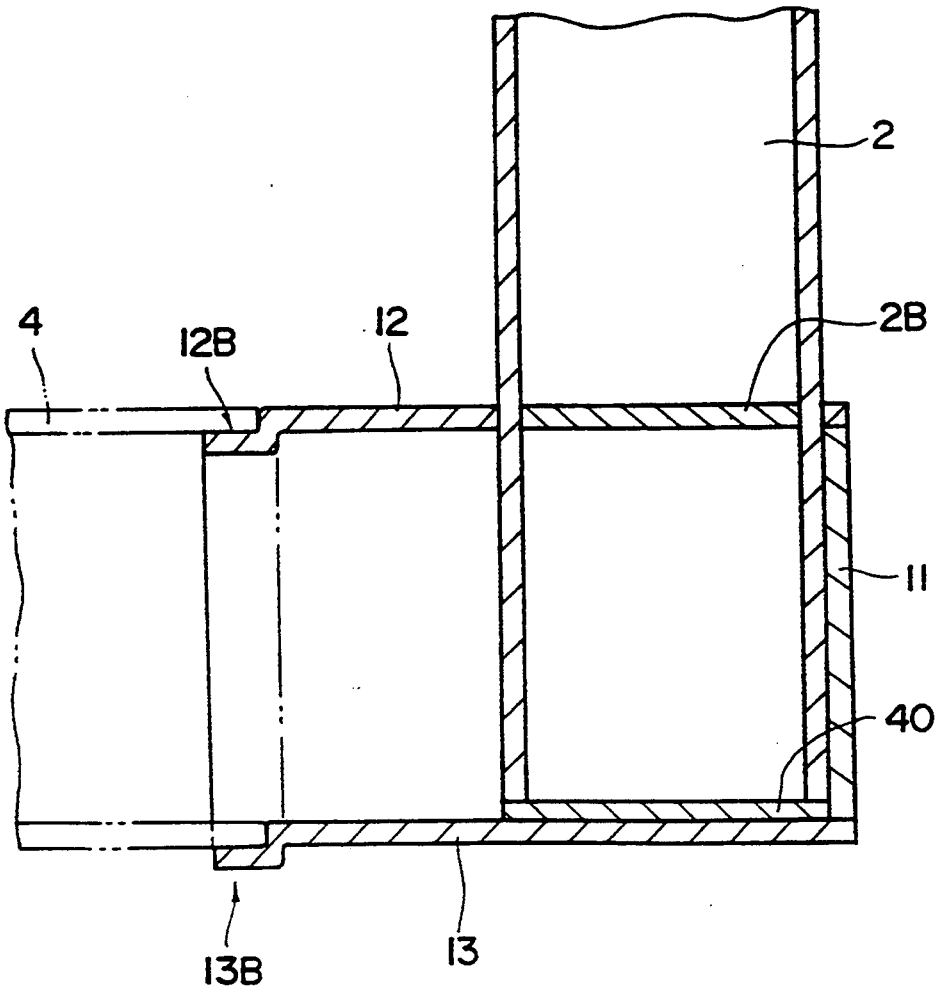
FIG. 14 is a sectional view of FIG. 12.

The column 2 used in the fourth embodiment should preliminary have an inner diaphragm 2B therein as shown in FIG. 14. The diaphragm 2B is provided at the same level of the flange 12 to reinforce the column 2 so that the force from the beam 3, 4 relates to the column 2.

The difference from the third embodiment can be summarized in a connecting situation between the connector 1 and the column 2. This connection is done by inserting the column 2 into the hole 12F of the flange 12, welding the forwarded end surface of the column 2 to the flange 3 while abutting to each other and welding a periphery of the column 2 closing to the hole 12F.

The connector 1 in the fourth embodiment also has the same effect as in the first embodiment.

FIFTH EMBODIMENT

The fifth embodiment of the present invention will hereunder be described with reference to FIG. 15.

Figure 15:
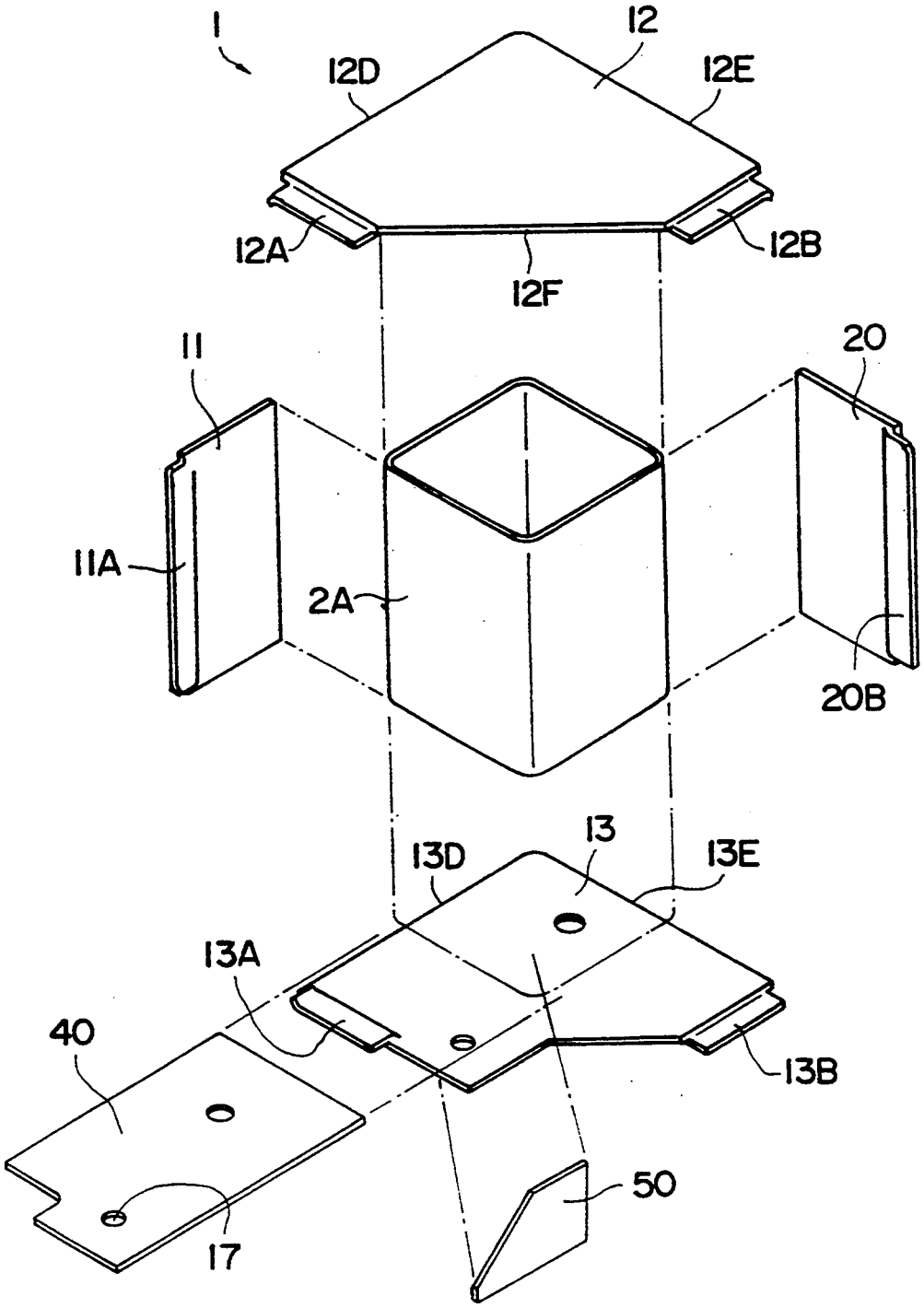
FIG. 15 is an exploded perspective view of a connector in the fifth embodiment of the present invention.

In FIG. 15 is shown a connector 1 in an exploded state.

The connector 1 comprises a connector main body 2A as the core portion, a pair of flanges 12, 13 and auxiliary webs 11, 20 as the branch portion, and reinforcing members 40, 50. The connector main body 2A is produced by shortly cutting the same material of the column 2, so that it has the same sectional shape as the column 2. The flanges 12, 13 and the auxiliary webs 11, 20 can be produced by punch pressing of steel plate. The flanges 12, 13 are the same as in the third embodiment. But each length of edges 12D, 13D, 12E, 13E of the flanges 12, 13 is longer than the sectional side length of the connector main body 2A.

The auxiliary webs 11, 20 is at a height by adding height of the connector main body 2A and thickness of the reinforcing member 40. The width of the auxiliary web 11 can be determined by subtracting the sectional one side length of the connector main body 2A from the length of the edges 12D, 13D. The width of the auxiliary web 20 can be determined by subtracting the sectional one side length of the connector main body 2A from the length of the edges 12E, 13E. These auxiliary webs 11, 20 are provided with guide edges 11A, 20B as in the first embodiment.

With the guide edges 11A, 20B having tapered portions at forwarded end portions of the auxiliary webs 11, 20, and guide edges 12A, 12B, 13A, 13B having same tapered portions of the pair of flanges 12, 13, beam joint portions for the beams 3,4 are formed as in the first embodiment.

A process for producing the connector 1 in the fifth embodiment will hereunder be explained.

The upper and lower flanges 12, 13 are respectively attached to the connector main body 2A so that their edges 12D, 12E, 13D, 13E correspond to the edges of the main body 2A crossing at a right angles. The both flanges 12, 13 are then joined with the connector main body 2A by welding along the entire edges of the main body 2A. The auxiliary webs 11, 20 are put to respective space enclosed by edges 12D, 13D and side edges of the main body 2A. The both upper and lower edges of the auxiliary webs 11, 20 are welded to the edges 12D, 13D, 12E, 13E.

As has been mentioned, the connector 1 can be produced by welding the connector main body 2A, the flanges 12, 13 and the auxiliary webs 11, 20 advantageously. Incidentally, the connector 1 also has the same beam joint portions consisting of tapered portions and guide edges as in the first embodiment.

The reinforced member 40, 50 may be used as in the first embodiment, if necessary.

The connector 1 in the fifth embodiment also has the same effect as in the first embodiment.

SIXTH EMBODIMENT

Figure 16:
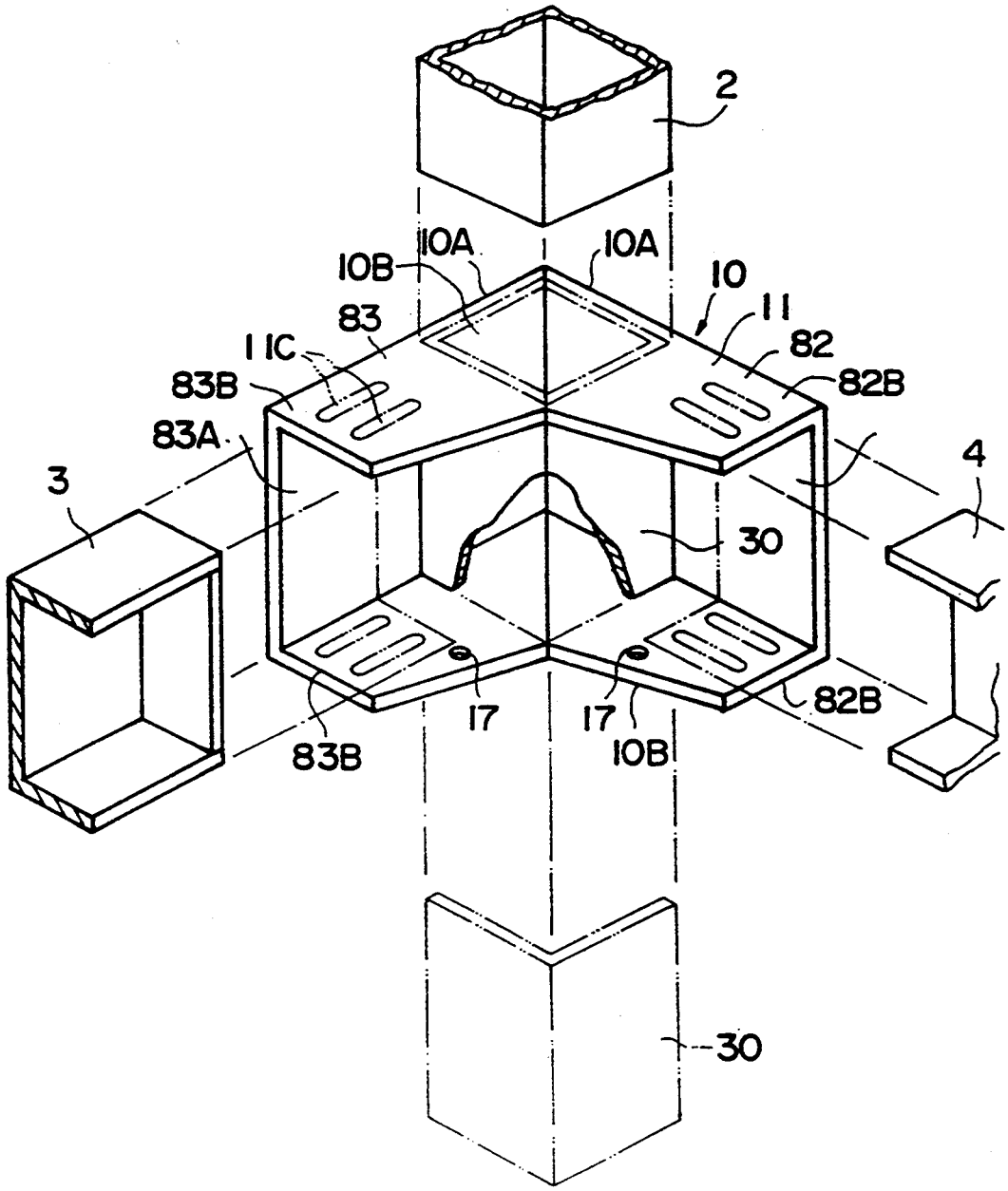
FIG. 16 is a perspective view showing a positional relationship among a connector in the sixth embodiment of the present invention, columns and beams.
Figure 17:
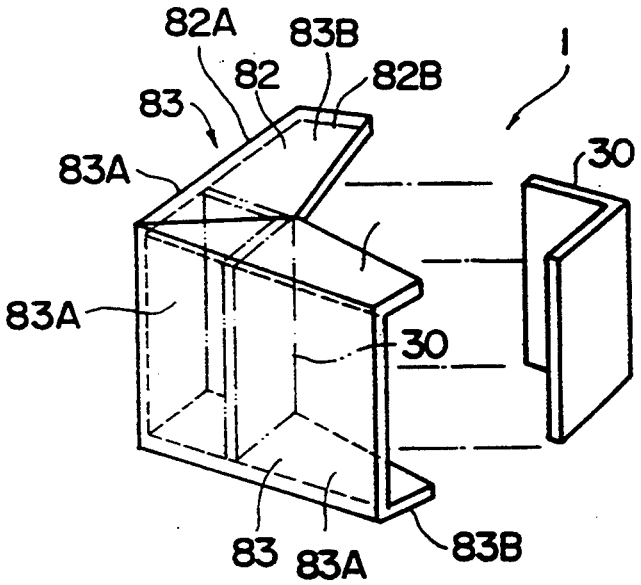
FIG. 17 is an exploded perspective view of the connector in FIG. 16.
Figure 18:
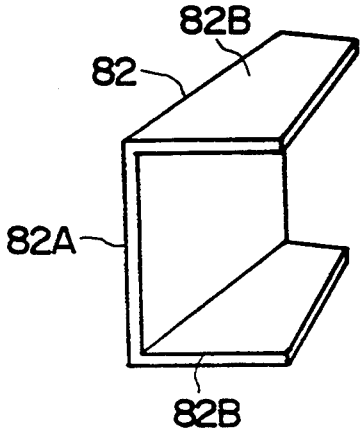
FIG. 18 is a perspective view of a partial member in FIG. 16.
Figure 19:
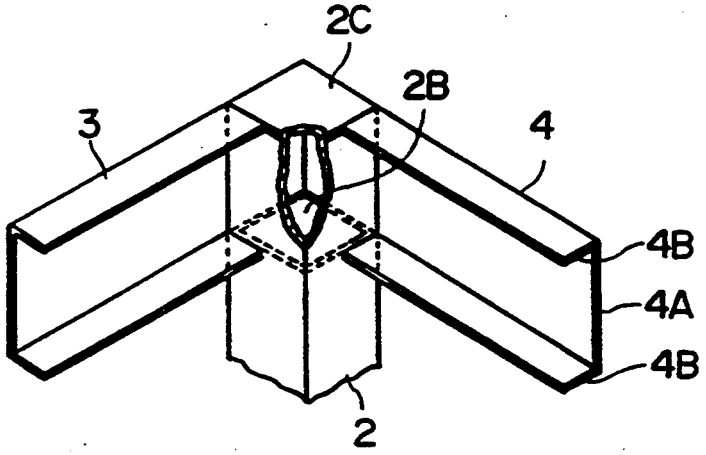
FIG. 19 PRIOR ART
FIGS. 19–21 are perspective views showing conventional joint structures of one column and two beams.
Figure 20:
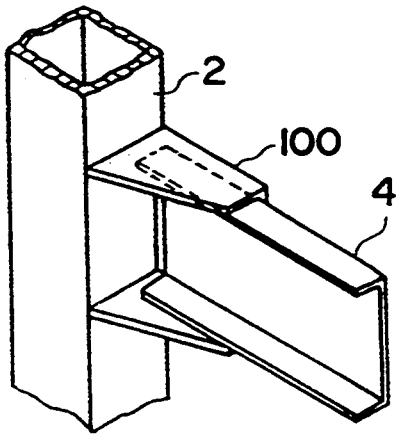
FIG. 20 PRIOR ART
Figure 21:
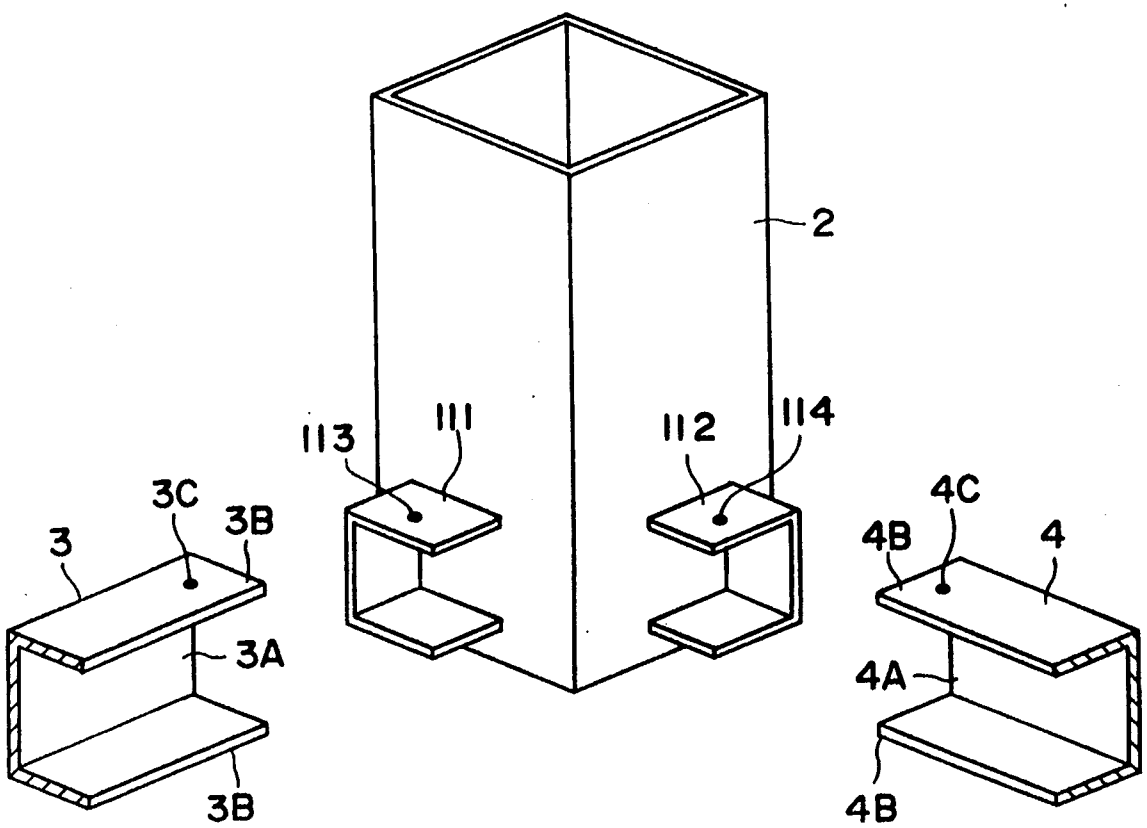
FIG. 21 PRIOR ART
Figure 22:
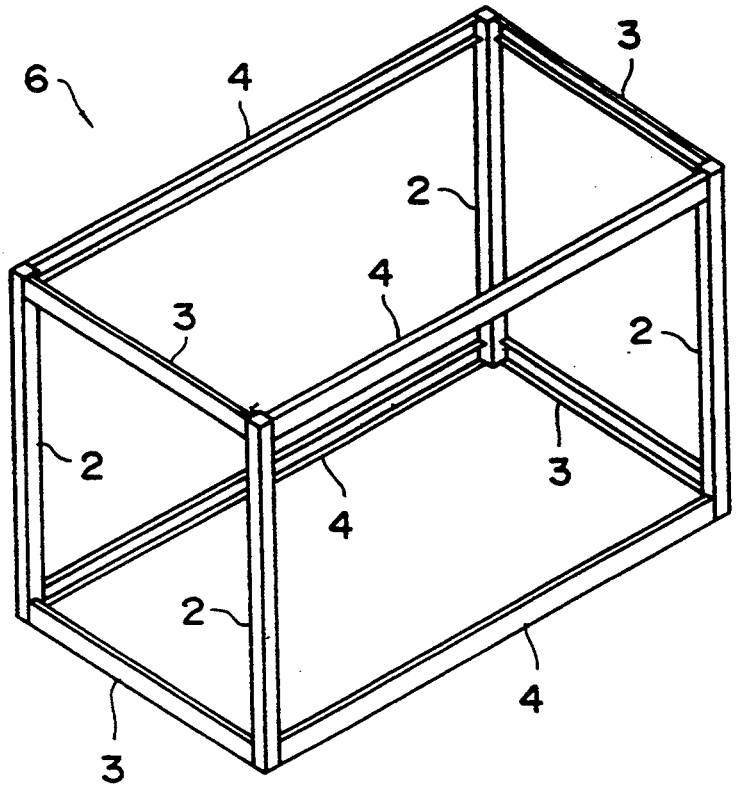
FIG. 22 PRIOR ART
FIG. 22 is a perspective view showing a general building unit frame.

The sixth embodiment of a connector 1 in the present invention will hereunder be explained according to FIGS. 16 through 18.

The connector 1 in this embodiment comprises a connector main body 10 as the branch portion which is formed into the letter L-shape by folding a U-shaped material and a L-shaped auxiliary member 30 as the core portion which is attached to an opened corner enclosed by the connector main body 10.

At a corner portion of an upper surface 10B of the connector main body 10 is welded a square column 2. Each U-shaped end portion of the connector main body 10 can be connected with the beam 3, 4 which is made of C-channel steel.

With a L-shaped corner outer wall 10A of the connector main body 10, the auxiliary member 30 forms the square-column like core portion similar to the column 2.

At outer side of the auxiliary member 30, where the beams 3, 4 do not place, on a lower surface 10B of the connector main body 10, holes 17 are provided, through which connecting bolts are inserted. These holes 17 are utilized to join with bolts one building unit frame, structured by the columns 2 and the beams 3,4 joined by the connectors 1, to the other.

The connector main body 10 consists of partial members 82, 83 being divided into two by a line sharing equally a top corner of right angles as shown in FIGS. 17, 18. These partial members 82, 83 have the same shape each other and are made of C-channel material.

The configuration of the partial member 82, 83 is defined by webs 82A, 83A standing straight and flanges 82B, 83B horizontally extending from both upper and lower edges of the webs 82A, 83A, whereby the member 82, 83 has almost a sectional U-shape.

The connector 1 in the sixth embodiment also has the same effect as in the first embodiment.

The connector main body 10 can be produced with two partial members 82, 83, of which each is made of C-channel material easily, so that producing such connector is not costly.

A process for welding the auxiliary member 30 to the connector main body 10 is easy because the welding can be done from outside.

What is claimed is:

1. A connector for connecting a column with two beams in a building unit, said connector comprising:

a core portion being formed with at least four walls and having cross sectional shape adapted to be operatively connected to the column;

a branch portion having a web and substantially parallel flanges extending generally perpendicular to the web, wherein said at least four walls of said core portion extend between said flanges so that said core portion is in substantial coaxial alignment with said column; and wherein one of said four walls is a portion of said web.

2. A connector for connecting a column with two beams in a building unit, said connector comprising:

a core portion having cross sectional shape adapted to be operatively connected to the column; and a branch portion having a web and substantially parallel flanges extending generally perpendicular to the web, wherein said core portion extends between said flanges in substantial coaxial alignment with said column, wherein said branch portion includes a connector main body and an auxiliary web, said connector main body having a U-shaped beam joint portion at one end portion thereof, whereby the beam adapted to connect to the beam joint portion and the column connects to the surface of at least one flange, said auxiliary web being attached to another U-shaped portion at an other end portion of the connector main body to form an other beam joint portion with forwarded end portions of the connector main body; and wherein said core portion is formed with the auxiliary web, a portion of the web of the connector main body and an L-shaped auxiliary member which is applied to an opened corner enclosed by the said web and the auxiliary.

3. A connector for connecting a column with two beams in a building unit according to claim 2, wherein at least one beam joint portion of the connector main body has a tapered portion in the direction of the beam and adapted to abut a connecting end of the beam, and a guide edge extended from the tapered portion.

4. A connector for connecting a column with two beams in a building unit according to claim 3, wherein the guide edge has an elongate hole to facilitate welding to the beam.

5. A connector for connecting a column with two beams in a building unit, said connector comprising:

a core portion having cross sectional shape adapted to be operatively connected to the column; and a branch portion having a web and substantially parallel flanges extending generally perpendicular to the web, wherein said core portion extends between said flanges in substantial coaxial alignment with said column, wherein a vertical surface of the web of the connector includes a pair of positioning holes and a web of the beam is formed with a third positioning hole, and further including a positioning tool having first, second and third positioning pins into the corresponding holes to provide alignment.

6. A building unit comprising:

a plurality of columns, a plurality of beams connected to said columns, a connector which includes a core portion being formed into the same shape as the column and a branch portion having a web and parallel flanges enclosing the web and extending at right angles thereto, said core portion having at least four surfaces extending at right angles to the flanges, one of said surfaces being defined by a portion of said web.

7. A connector for connecting a column with at least one beam in a building unit, said connector comprising a core portion and a branch portion having a web and substantially parallel flanges extending generally perpendicular to the web, wherein said core portion extends between said flanges, and wherein at least one of the flanges of the branch portion has edges adapted to abut with edges of said at least one beam in overlapping contact, wherein said flange edges are tapered to become gradually smaller in the direction of said beam to enable beams of different nominal thickness and internal dimension to be received on said branch portion.

8. The connector of claim 7, wherein only the edges of said at least one beam end are adapted to contact the branch portion and substantially only at said flange edges thereof.

9. A connector for connecting a column with at least one beam in a building unit, said connector comprising a core portion and a branch portion having a web and substantially parallel flanges extending generally perpendicular to the web, wherein said core portion has at least four walls which extend between said flanges in substantial coaxial alignment with said column; and wherein one of said four walls is a portion of said web.

10. A connector for connecting a column with at least one beam in a building unit, said connector comprising a core portion having cross-sectional shape adapted to be operatively connected to the column; and a branch portion having a web and substantially parallel flanges extending generally perpendicular to the web, wherein said core portion has at least four walls which extend between said flanges; and wherein one of said four walls is a portion of said web.

* * * * *